US010843899B2

(12) United States Patent
Lindberg et al.

(10) Patent No.: US 10,843,899 B2
(45) Date of Patent: Nov. 24, 2020

(54) SAFETY ELEMENT OF AN ELEVATOR SYSTEM

(71) Applicant: Inventio AG, Hergiswil (CH)

(72) Inventors: Bjarne Lindberg, Adligenswil (CH); Martin Rogger, Rotkreuz (CH); Oliver Wuethrich, Wolhusen (CH); Reto Hugentobler, Meggen (CH); Dario Augugliaro, Lucerne (CH)

(73) Assignee: INVENTIO AG, Hergiswil (CH)

( * ) Notice: Subject to any disclaimer, the term of this patent is extended or adjusted under 35 U.S.C. 154(b) by 333 days.

(21) Appl. No.: 15/763,891

(22) PCT Filed: Sep. 29, 2016

(86) PCT No.: PCT/EP2016/073169
§ 371 (c)(1),
(2) Date: Mar. 28, 2018

(87) PCT Pub. No.: WO2017/055387
PCT Pub. Date: Apr. 6, 2017

(65) Prior Publication Data

US 2018/0282119 A1 Oct. 4, 2018

(30) Foreign Application Priority Data

Sep. 30, 2015 (EP) ..... 15187692

(51) Int. Cl.
*B66B 5/00* (2006.01)
*B66B 11/02* (2006.01)

(52) U.S. Cl.
CPC ..... *B66B 5/0081* (2013.01); *B66B 11/0246* (2013.01)

(58) Field of Classification Search
CPC ..... B66B 5/0081; B66B 11/0226; B66B 11/0246
See application file for complete search history.

(56) References Cited

U.S. PATENT DOCUMENTS 600,759 A * 3/1898 Williams et al. ... B66B 11/0226 187/401
6,543,584 B1 * 4/2003 Miyakoshi ..... B66B 5/0081 182/113

(Continued)

FOREIGN PATENT DOCUMENTS

EP 1849732 A1 10/2007
ES 2554202 A1 7/2015

(Continued)

OTHER PUBLICATIONS

OSMA-AUFZUGE Albert Schenk GmbH & Co., Notice of Opposition to European Patent 3 356 272 B1, filed Aug. 6, 2020, European Patent Office (German language).

(Continued)

*Primary Examiner* — Minh Truong
(74) *Attorney, Agent, or Firm* — William J. Clemens; Shumaker, Loop & Kendrick, LLP

(57) ABSTRACT

An elevator system includes a car which can move in an elevator shaft and has a car roof which has a walkable region. A safety element is arranged in the region of a roof edge of the car roof for reducing the gap between the elevator shaft wall and the car in order to protect people from falling into the elevator shaft. The safety element has a toe board section for creating a toe protection and for laterally bordering the walkable region, wherein the toe board section is arranged such that it is inwardly offset in relation to an outer edge of the safety element and in relation to the roof edge by a safety distance.

9 Claims, 3 Drawing Sheets

(56) References Cited

U.S. PATENT DOCUMENTS

| | | | | |
|---|---|---|---|---|
| 7,140,473 | B2 * | 11/2006 | Det | B66B 5/0081 187/401 |
| 8,365,870 | B2 * | 2/2013 | Sirigu | B66B 13/22 187/306 |
| 9,174,825 | B2 * | 11/2015 | Bloch | B66B 5/0081 |
| 2005/0230194 | A1 * | 10/2005 | Nakamura | B66B 5/0081 187/401 |
| 2012/0031712 | A1 * | 2/2012 | Bloch | B66B 5/024 187/401 |
| 2012/0255814 | A1 * | 10/2012 | Bloch | B66B 11/0226 187/401 |
| 2018/0002139 | A1 * | 1/2018 | Stepp | B66B 11/0226 |
| 2018/0222723 | A1 * | 8/2018 | Gressien | B66B 11/0253 |
| 2019/0241399 | A1 * | 8/2019 | Kattainen | B66B 5/005 |

FOREIGN PATENT DOCUMENTS

| | | | |
|---|---|---|---|
| JP | H05330752 | A | 12/1993 |
| JP | H08133617 | A | 5/1996 |
| JP | 2002128433 | A | 5/2002 |

OTHER PUBLICATIONS

OSMA-AUFZUGE Albert Schenk GmbH & Co., Notice of Opposition to European Patent 3 356 272 B1, filed Aug. 6, 2020, European Patent Office (English translation).
Notice of Opposition D4-D7 Citations.
Notice of Opposition D8-D10 Citations.

* cited by examiner

SAFETY ELEMENT OF AN ELEVATOR SYSTEM

FIELD

The invention relates to an elevator system including a car which can move in an elevator shaft and has car roof with a walkable region, and with at least one safety element arranged in the region of a roof edge of the car roof for reducing the gap between the elevator shaft and the car to protect people from falling into the elevator shaft.

BACKGROUND

Elevator systems comprise cars which can move up and down in an elevator shaft with suspension means, for example, in the form of suspension cables or suspension straps, by means of a drive unit. For certain situations such as, for example, maintenance work or inspection, it is necessary that people climb on the car roof. If the gap between the car and the adjoining shaft wall is too wide, it is necessary to protect the people on the car roof from falling. A customary protective measure to prevent people on the car roof from falling is to set up balustrades on the car roof. The European standard EN81-20:2014, for example, contains exact instructions as to when balustrades are necessary as well as detailed specifications about the configuration and dimensioning of the car roof and the required balustrade.

As an alternative to balustrades, it is also common to provide safety elements on the car roof with which the gap between the elevator shaft and the car is made small enough so that people can no longer fall down from the car roof into the shaft. This type of elevator system with a safety element to reduce the gap between the elevator shaft and the car has become known from EP 1 849 732 A1. The safety element has an upper surface which adjoins approximately flush on the top of the car roof and which can be used as a foot rest. A toe protection is arranged at the outer edge of the safety element that laterally limits the walkable region. This arrangement has certain advantages, because it enlarges the walkable region which therefore reaches a high level of utilization, but the safety element itself must be of a stiff design and must be fastened to the car in a particularly stable manner. For certain applications, such as, for example, so-called machine room-less elevator systems, said arrangement may not be suitable for increased technical safety requirements. Machine room-less elevators are elevator systems in which the drive units are no longer arranged in a separate machine room, but in the elevator shaft. The drive unit is generally positioned at the top, i.e. in the region of the shaft head of the elevator shaft. When a person stands too far outward, it is possible that the person is injured when the car ascends. Parts of the shaft equipment protruding into the elevator shaft present a collision risk. Special attention must also be paid to the passing counterweight.

It is therefore a task of the present invention to avoid the disadvantages of the known arrangements and in particular to create an elevator system which guarantees the safety of maintenance personnel or other people on the car roof of the elevator system in a simple and cost-effective manner.

SUMMARY

According to the invention, the elevator system comprises a preferably vertically movable car in an elevator shaft, whereby the car comprises a car roof with a region that is walkable for maintenance work. The elevator system furthermore comprises at least one safety element arranged in the region of the roof edge of the car roof to reduce the gap between the elevator shaft and the car to protect people from falling into the elevator shaft. Roof edges are here the parts of the car body comprising the car floor, side walls, and car roof, which border the often essentially rectangular-shaped car body in the region of the car roof along the edges or respectively horizontally toward the outside. The car side walls attach vertically to the roof edges.

The safety element, which is used instead of a balustrade, in particular for overly large gaps between the car and the elevator shaft, protrudes the roof edge here by a horizontal overhang. Because the safety element comprises further stop means to create a toe protection and to laterally border the walkable region on the car roof, whereby the stop means are offset inwardly by a horizontal distance from an outer edge of the safety element, several advantages result. By inwardly offsetting the stop means, the safety element can be manufactured in an easy and cost-effective manner but can still adequately protect the person from a fall into the elevator shaft. Here, inwardly means toward the middle of the car roof or in the direction of the shaft wall located opposite the shaft wall in question. The danger of an accident during maintenance rides that is created by parts protruding into the elevator shaft or that are found otherwise in the shaft can be practically ruled out. The arrangement described above is preferably suitable for machine room-less elevator systems and in particular when an overlapping region exists between the drive unit and the car roof. Said overlapping region corresponds to the shadow cast or the vertical projection of the drive unit on the car roof. In this case, the stop means are arranged in an inwardly offset manner so that they are located on the car roof outside of this overlapping region. This way, the risk of injury for people on the car roof when taking the car up into the region of the shaft head of the drive unit can be reduced.

Preferably, the stop means can be arranged inwardly, offset by a safety clearance from the roof edge. In addition to technical safety advantages, this arrangement of the stop means leads to significantly reduced effort regarding the manufacture of safety elements and the mounting of the safety elements on the car roof. The safety element must not necessarily be extremely stiff to keep people safe.

The stop means can also define a stop region that continues diagonally to the horizontal and preferably vertically to the horizontal or respectively vertical stop surface for the feet or shoes of people. The stop means may be formed by a toe plate section. The toe plate section can preferably be at least 10 cm high, whereby a maximum height of 30 cm should generally not be exceeded. The toe plate section may, for example, be formed by a metal sheet or another laminar element.

From a technical safety aspect, it may furthermore be advantageous if the region of the safety element attaching outside to the stop means is designed in a non-accessible manner. The safety element is designed in this region in such a way that people are prevented from standing on the safety element. It should be made impossible for people to misuse the respective region of the safety element as a platform. This can be achieved, for example, by providing the safety elements with a particular shape. Additionally, or at best even only in the alternative, a warning notice (for example, a "do not enter" symbol) may be placed on the safety element in the region attaching outside to the stop means.

In an especially preferred embodiment, the safety element may comprise a canopy section that protrudes at the outside in a downward-sloping manner. The canopy section attaches here at the outside to the toe plate section. The sloping canopy section can easily prevent people from stepping or standing on the canopy section. The canopy section can be sloped down by an inclination of at least 10° and especially preferred by at least 20° from the horizontal.

The safety element may be shaped in such a way that an advantageous space is created between the safety element and the top of the roof to accommodate elevator components such as electrical car equipment, elevator accessories, or the like.

The safety element can be substantially formed in one piece and made from cut sheet metal. Steel sheets or other sheets made from metallic materials may be used for the cut sheet metal. The one-piece safety element can, for example, be a flexible part created by forming processes. In view of the variability, however, it may be advantageous if the security element is formed from several pieces. The multi-part safety element results in greater adaptation options to different shaft environments.

To form the multi-part safety element, it may be advantageous if the safety element is preferably made from a base profile part made from metallic materials to form a toe board section and a canopy profile part fastened to the base profile, which is preferably also made from a metallic material. The base profile part and the canopy profile part may, for example, be fastened together by screws, rivets, or other connection means.

For a sufficient stability of the security element in view of the fall protection, it may be advantageous if the security element has a holding part for supporting the canopy section. The holding part can here be attached to a side wall or to a side member associated with the side wall having a side in the vertical direction on which the holding part rests flat.

If the elevator system has a safety element facing a first shaft wall of the elevator shaft, it may be advantageous if this safety element has a projection to reduce the gap between the elevator shaft and the car in the region of a second shaft wall adjoining to the first shaft wall. This projection consequently faces the second shaft wall and can prevent people on the car roof from walking from the corner region between the first and the second shaft wall.

A single, contiguous safety element may be provided for each roof edge or respectively each side of the car where a type of fall protection is necessary due to overly large gaps between the elevator car and the shaft wall. For certain applications, however, it may be advantageous when several separate safety elements are provided along at least one roof edge on the car roof. Suspension straps or cables, guard rails, and other components attributable to the elevator shaft may contribute to the fall protection. If this is the case, two separate safety elements that are separated from each other may be provided, whereby the fall protection in the separation region between the two safety elements can be ensured by the guard rails, suspension means, or possibly other shaft equipment.

In a top view, or respectively from a vertical perspective, the safety element can, at least in reference to an area protruding over the roof edge, be configured openly or at least semi-openly, whereby a free space is created so that components associated with the elevator shaft can be guided past the safety element during a car ride through the free space. The safety element may, for example, comprise a U-shaped bracket as a safety element for the fall protection. The safety element could be box-shaped as well with the cavity of the box forming the aforementioned free space. For the previously mentioned embodiment, the safety element may, in a top view, comprise an L shape to form the free space.

Further individual features and advantages of the invention are derived from the following description of exemplary embodiments and from the drawings.

DESCRIPTION OF THE DRAWINGS

Shown are.

DETAILED DESCRIPTION

Figure 1:
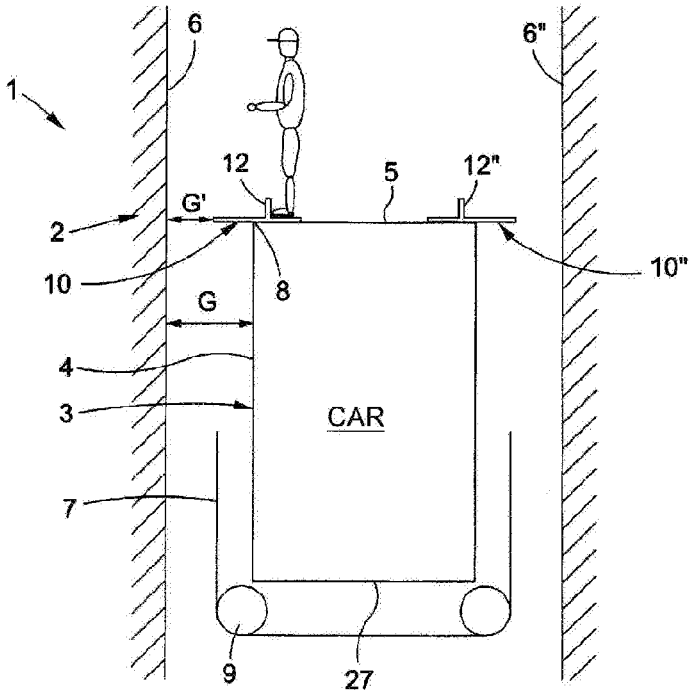
FIG. 1 is a highly simplified illustration of an elevator system with safety elements from a side view.

FIG. 1 shows an elevator system for a building identified as a whole by reference number 1. The building has an elevator shaft 2 or several elevator shafts, as needed. The elevator system 1 comprises a car 3 that can be moved vertically up and down to transport people or goods by means of a drive unit in the elevator shaft 2. The car 3 comprises a car floor 27, side walls 4, and a car roof 5. The movement of the car 3 is carried out, for example, with suspension means 7 that suspend the car 3 in the form of an under-looping in a 2:1 suspension. Suspension means 7 can, for example, be one or more suspension cables or suspension straps. The suspension means 7 are looped around the car 3 by means of guide rollers 9. Different suspension configurations would be conceivable as well, of course. The (not shown) drive unit to move the car 3 is fastened to the shaft wall identified with the number 6 to form a machine roomless elevator that moves the car 3. The drive unit may have a rotatable traction sheave. For reasons of improved clarity, the other components of the elevator system such as a counterweight attached to the car, guide rails to guide the counterweight and the car, or control means to control or regulate the elevator systems are not shown.

The car roof 5 can be walked on for the performance of maintenance work or for inspection runs. If the gap between the car 3 and the elevator shaft 2 surpasses a certain gap width G, the people on the roof must be protected from a fall into the elevator shaft. The gap width G corresponds here to the horizontal free distance between the side wall 4 and the shaft wall 6. The standard EN81-20:2014 requires the use of balustrades, for example, from a gap width of 30 cm. Consequently, a gap between the car 3 and the elevator shaft 2 with a gap width G of 30 cm or more can also be referred to as an "overly large" gap. As long as the required fall protection can be ensured, solutions other than balustrades are conceivable as well. Such an alternative fall protection solution is shown in FIG. 1. At the sides of the car roof 5, a security or safety element 10, 10" is arranged to reduce the gap between the elevator shaft 2 and the car 3 to protect people from falling into the elevator shaft. It is obvious that the safety element 10 protrudes from a roof edge 8 of the car 3 far enough that, at least locally, only a gap with a smaller gap width G' remains. The gap width G' can, for example, be less than 30 cm, whereby the standard EN81-20:2014 would be met.

The safety element 10, which is shown in a simplified form in FIG. 1 as a plate-like, flat structure that rests against the roof top of the car roof 5, furthermore comprises stop means 12 that jut away from the car roof in an approximately vertical direction to create a toe protection. Since, in this case, a second, similarly configured safety element 10" is arranged on the opposing side of the car roof 5 that faces the shaft wall 6" and that determines the walkable region on the car roof, the person may move more or less freely in the region between the stop means 12 and 12".

Figure 2:
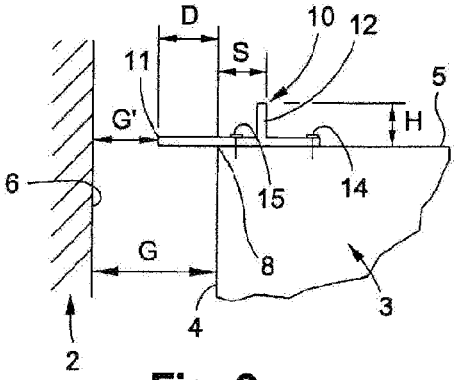
FIG. 2 is an enlarged detail view of a safety element of the elevator system according to FIG. 1.

Further details about the configuration of the safety element 10 and its arrangement on the car roof 5 of the car 3 are shown in FIG. 2. Here, the safety element 10 is formed, for example, by a T-shaped profile. The T profile may be comparatively thin, whereby the wall strength of the profile must be designed in such a way that the exposed part of the safety element 10 firmly attached to the car roof and protruding by the distance D from the roof edge 8 can hold the weight of a person, for example, after a fall caused by tripping, so that the person does not fall between the shaft wall 6 and the side wall 4 of the car 3 and into the shaft pit. The term "supernatant" is used in this application for the distance D. Regarding the configuration and dimensions of the safety elements 10, a person skilled in the art can assume that the safety element must be able to withstand a vertically acting force of 500 N on the relevant region, i.e., the region adjacent to the stop means 12 at the outside. For increased safety requirements, however, values such as 1000 N and above can be assumed. To attach the safety elements 10 on the car roof, attachment means 14, 15 are provided, for example, in the form of screws.

The gap with the gap width G' that remains after the extension created by means of the safety element 10 is so reduced that people can no longer fall through the gap. As FIG. 2 shows, the gap width G' is measured between the outer edge 11 of the safety element 10 and of the shaft wall 6. Should further parts such as suspension means or guard rails be arranged in the shaft in sufficient proximity (e.g., closer than 30 cm to the car) and therefore prevent a fall, the distance G' would not be measured as the distance to the shaft wall itself, but locally in reference to the guard rail, the closest suspension means, or any other parts, if necessary.

FIG. 2 shows that the stop means are formed to laterally limit the walkable region with a toe board section 12 that is integrally shaped to the horizontal, plate-shaped base section and that may protrude in an approximately perpendicular manner from this base section. The toe board section 12 is inwardly offset from the roof edge 8 by a safety distance S. The distance D+S of the safety element to the outer edge 11 should preferably not be longer than 15 cm. The height H of the toe board section 12 is 10 cm, for example.

Figure 3:
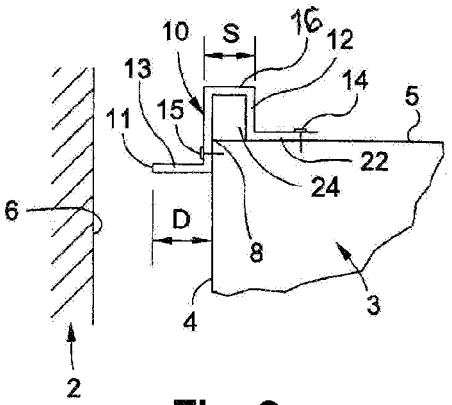
FIG. 3 shows a second embodiment of a safety element from the side view.
Figure 4:
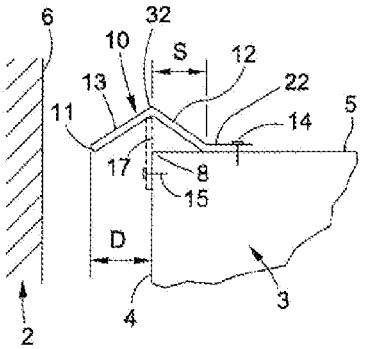
FIG. 4 shows a third embodiment of a safety element.
Figure 5:
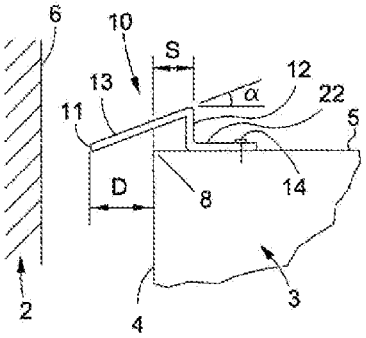
FIG. 5 shows a fourth embodiment of a safety element.

Other embodiments of safety elements 10 are shown in FIGS. 3 to 5 below. Their total mass has remained when compared with the embodiment according to FIG. 1 and FIG. 2, which is why these figures do not identify the gap width (G, G') and height (H) of the safety element.

FIG. 3 shows a safety element 10 that is formed as a flexible part with four angles similar to a hat profile. Due to the special form of the profile, a rectangular cavity 24 is formed between the safety element 10 and the top of the car roof 5. The safety distance S is provided by the horizontal central profile section 16. The vertical toe board section 12 attaches on the inside of the profile section 16. The section of the safety element 10 that runs parallel to the toe board section 12 abuts against the car side wall 4. The symbolically indicated screws referenced with 14 and 15 used to attach the safety element to the car 3 are, as can be seen, associated with two different attachment levels. On one side, the screw 14 is used to directly attach the safety element to the car roof, and on the other side, it is attached to the side wall 4 with screws 15. The region protruding over the roof edge 8 by the supernatant D is formed by the canopy section referred to with 13. Compared to the preceding embodiment, wherein the region D+S forms a common area, the variant according to FIG. 3 with the separated surfaces D, S has the advantage that even with larger gaps—thanks to the comparatively short canopy section 13 with D as the length of the canopy—any trespassing on the safety elements 10 behind the stop means can be made impossible in a very easy manner.

As FIG. 4 shows, the toe board section 12 and the canopy section 13 can be configured at an incline in the sectional view. The sections 12 and 13 that turn toward each other in a wedge-shaped, obtuse-angled manner form an upper edge 32. To stabilize the safety elements 10, a holding part 17, which is indicated by a dashed line, may be used to support the safety element in the downward direction in the area of the edge 32. The holding part 17 can be attached to the car 3 in the area of the side wall 4 by means of screws 15.

FIG. 5 shows another safety element 10 with an inclined canopy section 13. The inclined canopy section 13 attaches to the toe board section 12 that runs at a right angle to the top of the car roof 5. The canopy section is inclined downward from the horizontal by an inclination angle $\alpha$. The inclination angle $\alpha$ may be 10°, for example, or more. The attachment section 22 attaches at the inside of the toe board section 12, through which the safety element 10 is attached to the car roof 5. In the exemplary embodiment according to FIG. 5, the safety element is configured as a one-piece flexible part made from sheet metal. It is conceivable as well, however, to make the profile part for the safety element 10 from aluminum. The inclined canopy section 13 is realized here in a detached manner. Of course, it is also conceivable to support the canopy section by means of additional holding parts and to thus create an even more stable safety element 10.

Figure 6:
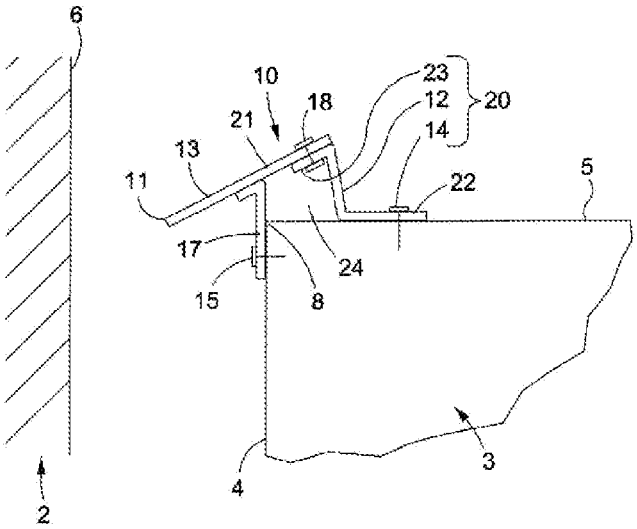
FIG. 6 shows a variant of the safety element according to FIG. 5 in a once again enlarged detail view from the side.

The safety element 10 according to the embodiment of FIG. 6 is similar to the safety element 10 of FIG. 5 in terms of shape and dimensions. The canopy section 13 is positioned approximately equal to an angle with respect to the car roof 5. The toe board section 12, however, no longer runs perpendicular but is (in the cross section) slightly inclined in its form. The most essential difference to the previous embodiment is that the safety element 10 according to FIG. 6 is constructed from several parts. A planar canopy profile part 21 forms the canopy section 13. The toe board section 12 is, however, formed by a substantially Z-shaped foot profile part 20 in the cross section. This foot profile part can easily be manufactured from sheet metal blanks through folding processes or other molding processes. The foot profile part 20 comprises the toe board section 12, which is joined on both sides by the attachment section 22 for attachment to the top of the roof and a connecting section 23 for the connection with the canopy profile part 21. The canopy profile part 21 lies flat on the connection section 23 of the foot profile part 20; the foot profile part 20 and the canopy profile part 21 are attached to each other by means of a screw connection 18. The holding part 17 is attached to the car 3 by means of screws 15 in the region of the side wall 4. At the top end, the holding part 17 is angled in such a way that the canopy profile part 21 lies flat on the angled part of the holding part 17 and is supported by it.

Figure 7:
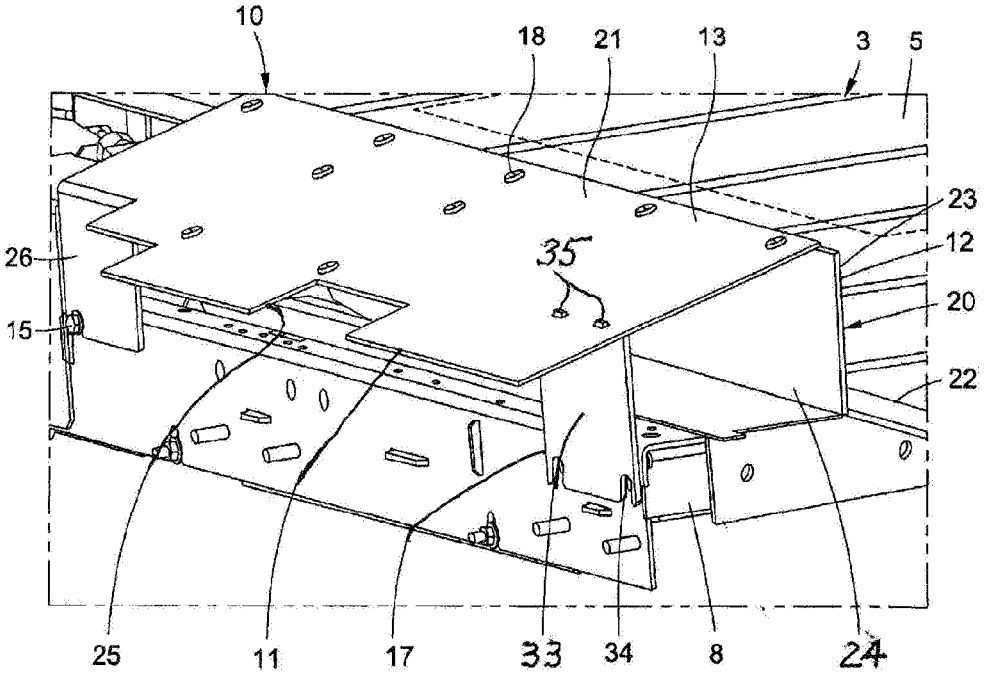
FIG. 7 is a perspective view of a car roof with a safety element of the type of FIG. 6.

FIG. 7 shows design details of a car 3 with a safety element 10 attached to it in another variant. As can be clearly seen here, the canopy profile part 21 is attached to the foot profile part 20 by means of screws 18. To support the canopy section 13, a separate holding part 17 is provided on one side and a holding section 26 on the other side. The holding part 17 securely holds the canopy profile part 13 via a connector 33. For the connector, two pins 35 are integrally formed on the holding part 17 which are received in the corresponding openings in the canopy profile part 21. The holding part 17 is attachable to the car 3 by means of screws (not shown). For this purpose, the holding part has two elongated holes 34 at the lower part through which the screws can be screwed into the car roof 5. The roof edge 8 is formed by an angle profile. Furthermore, a holding section 26 formed by folding is integrally formed on the canopy section 13 that is affixed to the car roof 5 by means of screw 15.

As further seen in FIG. 7, the outer edge 11 of the safety element 10 facing the shaft wall does not have to be straight over the entire length. Approximately in the middle, a rectangular recess 25 that is open toward the adjacent shaft wall is provided, whereby the edge 11 is locally set back. This recess 25 enables a safe drive past components which are attributable to the elevator shaft.

Figure 8:
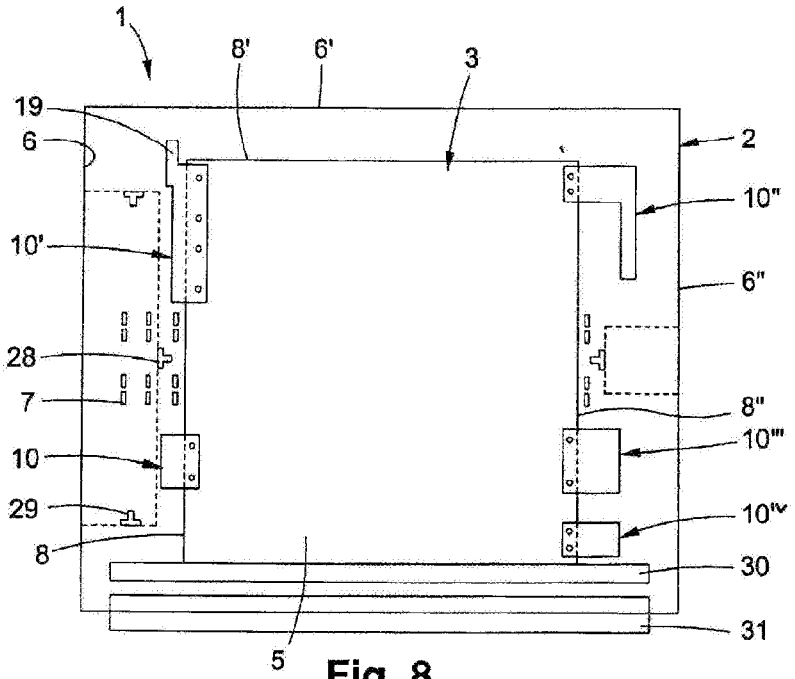
FIG. 8 is a top view of an elevator system with a car provided with a plurality of safety elements on the car roof.

The illustration of the elevator system 1 according to FIG. 8 shows a possible security system for a car 3. On one side of the car 3 is the only symbolically shown car door 30. The reference number 31 relates to an elevator door of the elevator shaft 2. In FIG. 8, the suspension means 7 are formed, for example, by straps. Also visible are the guide rails 28 to guide the car 3 and the guide rails 29 for the counterweight (not shown). As it is apparent from the top view of the car roof 5 of the elevator car 3, this elevator system 1 has a car 3 with a plurality of safety elements 10, 10', 10", 10''', 10$^{iv}$. Two safety elements 10 and 10' are arranged on the roof edge 8, and three safety elements 10", 10''', and 10$^{iv}$ are arranged on the roof edge 8" on the opposite side. Since the suspension straps 7 and the car guide rails 28 are sufficiently close to the car, these parts can prevent a fall of a person on the car roof. Consequently, as shown in FIG. 8, no safety elements have to be provided on the car roof 5 here. Since the counterweight guide rail identified as 29 is located on the roof edge 8 on the side that is opposite to the safety element 10$^{iv}$, no safety element must be provided in this area, either. The safety element 10' adjacent the first shaft wall 6 facing the elevator shaft 2 includes a continuation 19 to reduce the gap between the elevator shaft 2 and the car 3 in the region of a second shaft wall 6' adjoining the first shaft wall 6.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including a car which can move in an elevator shaft and has a car roof with a walkable region, and at least one safety element arranged in a region of a roof edge of the car roof for reducing a gap between the elevator shaft wall and the car to protect people from falling into the elevator shaft, wherein the at least one safety element protrudes over the roof edge by a horizontal supernatant away from the car, comprising: the at least one safety element includes stop means that jut away from the car roof in an approximately vertical direction and laterally limiting the walkable region, whereby the stop means is inwardly offset in relation to the roof edge; wherein the horizontal supernatant portion of the at least one safety element includes a downward inclined canopy section.

2. The elevator system according to claim 1 wherein the stop means is inwardly offset by a safety distance in relation to the roof edge.

3. The elevator system according to claim 1 wherein the at least one safety element includes a toe board section forming the stop means.

4. The elevator system according to claim 1 wherein a region of the at least one safety element adjacent to an outside of the stop means is configured to be non-walkable by a person.

5. The elevator system according to claim 1 wherein the at least one safety element includes a holding part supporting the canopy section.

6. The elevator system according to claim 1 wherein the at least one safety element is constructed from several parts.

7. The elevator system according to claim 1 wherein a plurality of separate ones of the at least one safety element is provided along at least one roof edge of the car roof.

8. The elevator system according to claim 1 wherein the at least one safety element, in a region protruding from the roof edge, includes an open or semi-open free space permitting components in the elevator shaft to be guided through the free space past the at least one safety element.

9. The elevator system according to claim 1 wherein the at least one safety element has an L shape in a top view.

* * * * *